United States Patent [19]

Ornduff, Sr.

[11] Patent Number: 5,064,230

[45] Date of Patent: Nov. 12, 1991

[54] LOCKING MECHANISM

[75] Inventor: William L. Ornduff, Sr., Gordonsville, Va.

[73] Assignee: Kirtley Distributing Company, Inc., Charlottesville, Va.

[21] Appl. No.: 673,533

[22] Filed: Mar. 22, 1991

[51] Int. Cl.[5] ..... E05C 9/16

[52] U.S. Cl. ..... 292/223; 292/217; 292/DIG. 61; 292/DIG. 49; 49/449

[58] Field of Search ..... 292/223, 345, 217, DIG. 49, 292/DIG. 61, DIG. 43; 49/449, 450

[56] References Cited

U.S. PATENT DOCUMENTS

| | | | |
|---|---|---|---|
| 337,938 | 3/1886 | Dunning . | |
| 460,798 | 10/1891 | Ives . | |
| 2,188,335 | 1/1940 | Claud-Mantle | 292/217 X |
| 2,866,663 | 12/1958 | Ashford | 296/24 |
| 3,135,544 | 6/1964 | Mickey et al. | 296/24 |
| 3,416,836 | 12/1968 | Swanby | 296/148 |
| 3,572,815 | 3/1971 | Hackney | 296/40 |
| 3,708,192 | 1/1973 | Klebba et al. | 292/261 |
| 3,801,145 | 4/1974 | Mauritz | 292/184 |
| 3,847,423 | 11/1974 | Gley | 292/DIG. 49 X |
| 3,990,739 | 11/1976 | Head | 296/56 |
| 4,142,751 | 3/1979 | Varda | 292/217 |
| 4,620,744 | 11/1986 | Yui et al. | 296/155 |
| 4,623,178 | 11/1986 | Geringer et al. | 292/DIG. 61 X |

*Primary Examiner*—Richard E. Moore

*Attorney, Agent, or Firm*—James H. Beusse

[57] ABSTRACT

A latching mechanism for roll-up type doors on a vehicle truck body in which a rotatable rod extends through the truck body adjacent a top edge of the doors and has flanges for engaging the doors. A first lever arm coupled to one end of the rod enables rotation of the rod, and a second lever arm coupled between the first lever arm and the latching mechanism controls the relative rotational position of the rod. The latching mechanism comprises a housing assembly for attachment to the truck body, a rotatable support mounted in the housing and a third lever arm attached to the support and extending from the latching mechanism. An end of the third lever arm is connected to the second lever arm for effecting its movement in response to rotation of the support. First and second stops limit rotation of the support while a tension spring urges the support against the stops. One end of the spring is coupled in sliding engagement with the housing assembly so that the spring slides during operation of the latch whereby the spring always tensions the third lever arm toward a selected one of the stops.

4 Claims, 3 Drawing Sheets

LOCKING MECHANISM

The present invention relates to vehicle door locking systems and, more particularly, to a latching mechanism for roll-up type doors on a vehicle truck body.

BACKGROUND OF THE INVENTION

Various types of compartmented truck bodies are used commercially as delivery vehicles and are provided with roll-up doors over each of the compartments of the truck. Such trucks are commonly used for delivery of soft drinks such as colas and for beer. Since these delivery trucks are often left unattended during deliveries, it is desirable to provide a locking mechanism for latching the roll-up doors in a down and closed position. For many years, the typical latching mechanism for such vehicle truck bodies has utilized a rotatable rod extending the length of the truck body above a top edge of each door. A plurality of flanges are fixedly attached to the rod so that they engage the top edge of the door when the rod is rotated through a preselected angle. A lever arm is connected to the rod and leads downward through other lever arms to a latching mechanism located at an operator level. The latching mechanism generally comprises an externally visible handle connected through an aperture in the truck body to a spring loaded mechanism either inside the truck body or in a wall of the truck body. The spring loaded mechanism utilizes a compression spring to hold the latching mechanism in either a locked or unlocked position. It has been common experience that the compression spring utilized in the latching mechanism tends to fail after repeated use. The compression spring is loaded not only by the latching mechanism but by the weight of the connecting arms extending up to the rotatable rod. This load on the compression spring causes it to lose some of its spring constant and become weakened thereby allowing the lever arm assembly to partially collapse and permit the rod to rotate through some limited angle. As the rod rotates, the flanges on the rod may lose contact with the top edge of the door so that the doors can be opened without releasing the latching mechanism. Alternatively, the loss of the spring constant may allow the rod to rotate towards the closed position when the doors are in their upright and open position so that when the doors are thereafter closed, the flange on the rod contacts and rubs against the door faces. This contact between the locking flange and the door faces not only mars the surface but can remove the finish to an extent that corrosion of the door face may occur.

SUMMARY OF THE INVENTION

It is an object of the present invention to provide an improved latching mechanism which overcomes the above and other disadvantages of the prior art.

In one form, the present invention incorporates a secondary tension spring and a support attached to the latching mechanism for holding the tension spring. The support extends parallel to the latching mechanism and includes a slot into which one end of the tension spring is attached. A second end of the tension spring is connected to an end of a lever arm extending from the latching mechanism. As the lever arm is moved into an up position, the end of the tension spring within the slot slides to the upward end of the slot to thereby pull the lever arm into its full upright and locked position. When the lever arm is manually moved to its down position, the end of the spring within the slot slides to the lower end of the slot to again pull the lever arm downward into its full down position. By allowing this spring to slide in the slot on the secondary support, the spring operates as an overcenter function and the amount or degree of lengthening of the spring during movement of the lever arm is minimized. The support and spring may be attached to existing latching mechanisms thus providing a significant advantage for use with latching mechanisms which have lost their ability to retain the lever arms in locked and unlocked positions.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
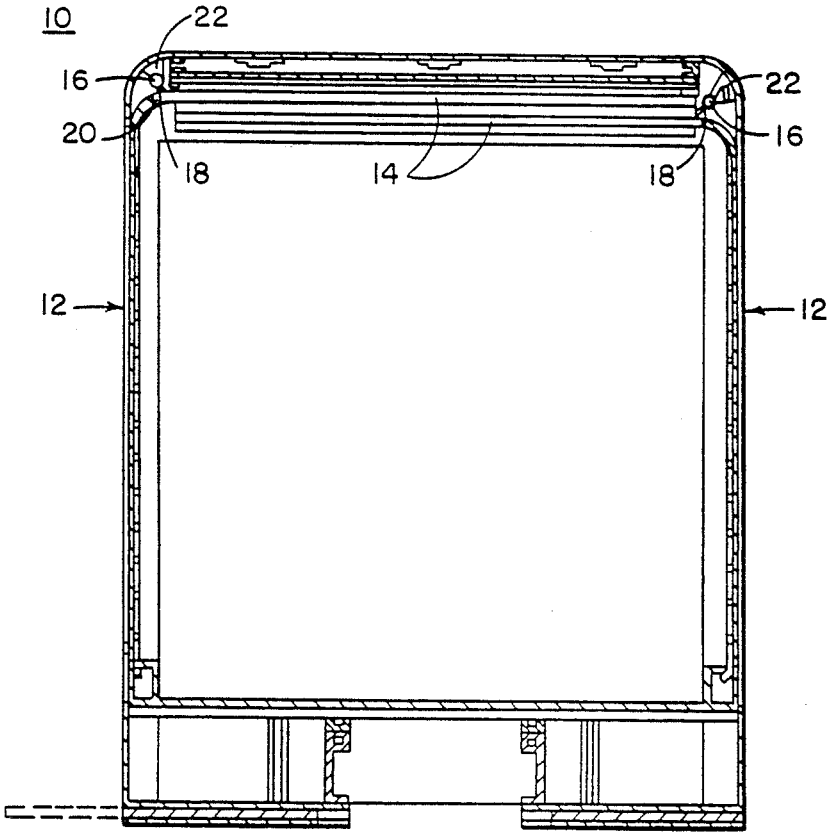
FIG. 1 (PRIOR ART)
FIG. 1 is a simplified, cross-sectional view of a vehicle truck body with which the present invention is particularly useful.

Turning first to FIG. 1, there is shown a simplified cross-sectional view of the rear of a vehicle truck body 10 having a plurality of roll-up doors 12 for which the latching mechanism of the present invention is particularly useful. Each of the doors 12 is formed of a plurality of interlocking strips in a manner well known in the art. The doors ride in vertical guides along the sides of the truck and in horizontal guides 14 at the top of the truck body. These truck bodies are used for delivery of various goods, such as for example, soft drinks and beer. Consequently, the trucks are often left unattended and it is therefore desirable to provide some means for locking the roll-up doors during a driver's absence. In general, the common locking mechanism uses a rotatable rod 16 extending the length of the truck body and having a plurality of flanges 18 fixedly attached so as to engage an edge 20 of each door 12 when the door is in a down or closed position. The rod 16 is supported in brackets 22 attached to the truck body 10. As shown, there is generally a rod 16 on each side of the truck body.

Figure 2:
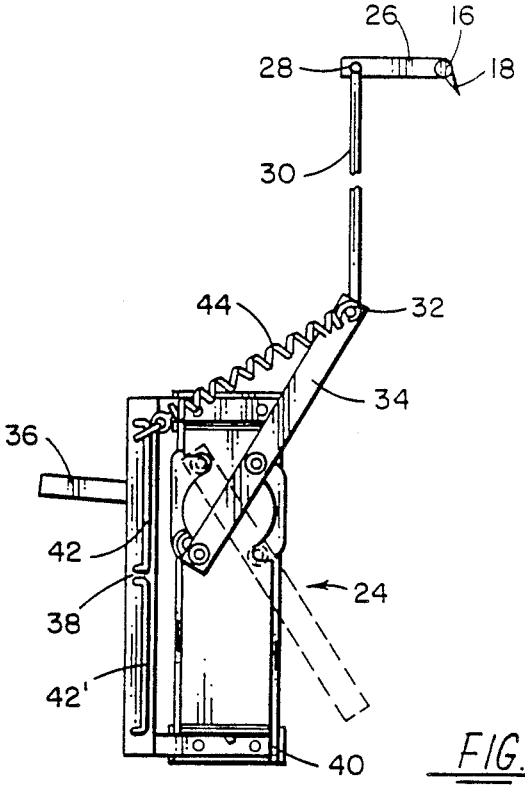
FIG. 2 (PRIOR ART)
FIG. 2 is a simplified view of a latching system for the truck body of FIG. 1 showing use of the present invention.

FIG. 2 is a simplified view of a latching mechanism 24 adapted to effect a preselected degree of rotation of the rod 16. At one end of the rod 16 there is attached a first lever arm 26. A distal end of the lever arm 26 is coupled to a first end 28 of a second lever arm 30. A second end 32 of lever arm 30 is coupled to the latching mechanism 24, or more particularly to an end of a third lever arm 34 extending from the mechanism 24. The mechanism 24 is operated by a handle 36 coupled to lever arm 34 which is effective to move the lever arm 34 from the up and locked position shown in solid lines to the down and released position shown in broken lines. In the solid line position, the flange 18 is held against the edge 20 of the door 12 and prevents the door from being raised. In the broken line position, the rod 16 is rotated so that the flange is raised and allows the door 12 to be raised.

In the present invention, the mechanism 24 includes a secondary support 38 attached at each end thereof to a housing or housing bracket 40 of the mechanism 24. The support 38 includes a pair of slots 42 and 42' extending parallel to the direction of travel of the second lever arm 30. A tension spring 44 has one end attached to an end of lever arm 34, preferably at the juncture of arm 34 and arm 30. A second end of spring 44 is connected to support 38 at slot 42. When arm 34 is moved from its up position to its lower position, the second end of spring 44 slides in slot 42 so that the force of spring 44 is always in a direction to urge lever arm 34 into the desired position. The end of spring 44 also slides upward in slot 42 when the arm 34 is moved from a lower to an upper position.

Figure 3:
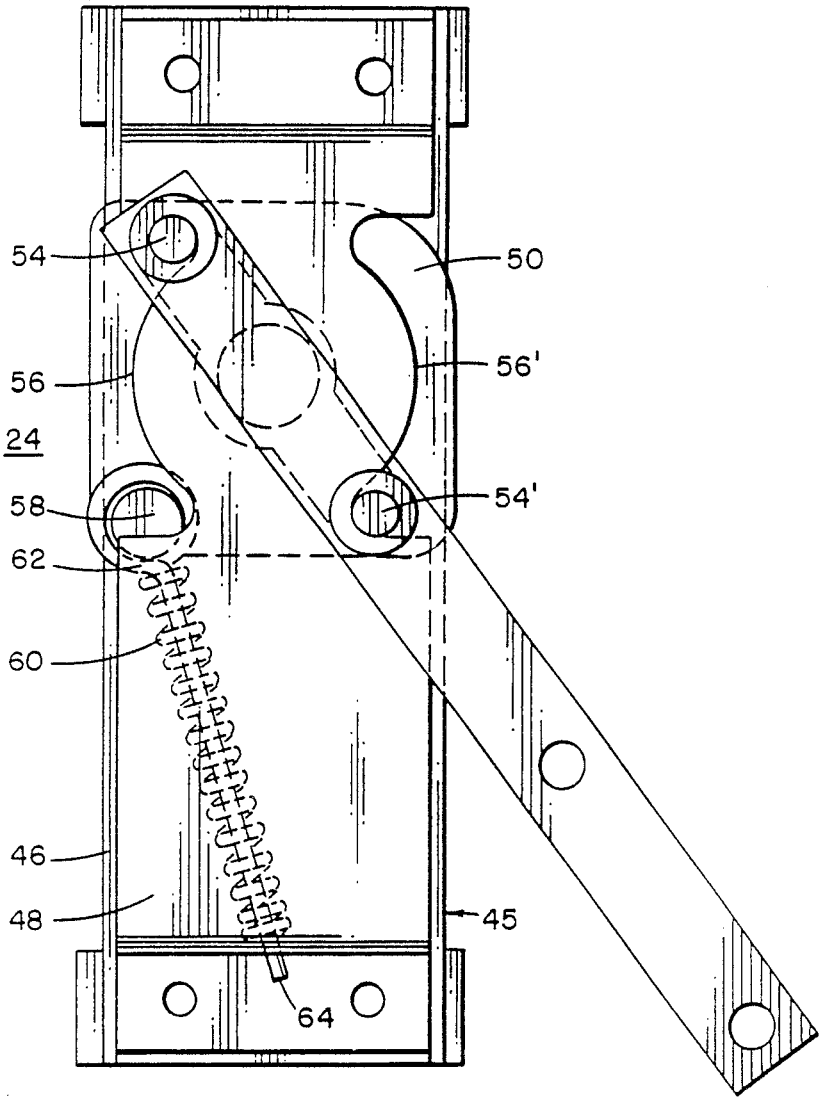
FIG. 3 (PRIOR ART)
FIG. 3 is a planar view of a prior art latching mechanism.

A better appreciation of the advantages of the present invention over prior art latching mechanisms may be had by reference to FIG. 3, which is a top view of the mechanism 24 with the support 38 and spring 44 removed. In addition, the components of the mechanism are shown as transparent in order to explain their relationship. The mechanism 24 includes a housing 45 comprising a base plate 46 and a top plate 48. Sandwiched between the plate 46 and plate 48 is a rotatable support 50 having an essentially square shape in the top planar view. Raised circular bosses 52 are formed on the top and bottom surfaces of the support 50 and fit within mating apertures in the base and top plates 46, 48 so as to allow the support to be rotatable between the plates. At two opposing corners of the support 50 a pair of pins 54, 54' are fixedly attached and extend upward above the surface of the top plate 48. The plate 48 is notched on opposite sides above the support 50 so that the pins 54, 54' are free to move laterally within the confines of the notches. Each end of each of the notches (the notches being identified at 56, 56') constitutes a stop for limiting rotation of the support 50 when the pins 54, 54' contact the stops. The pins 54, 54' also provide a means of attaching lever arm 34 to the mechanism 24. In particular, the pins 54, 54' extend upward through mating apertures in the lever arm 34. The arm 34 is then held in place by cotter pins (not shown) extending through holes in the pins 54, 54' or by threading the ends of the pins 54, 54' and attaching nuts.

A third pin 58 extends upward from another corner of support 50 but terminates below the lower surface of top plate 48. This third pin 58 is used in prior art devices to maintain the position of arm 34 by use of a compression spring 60. A guide pin 62 has an eyelet on one end which encircles pin 58. Another end of pin 62 extends through an aperture 64 in an endwall of top plate 48. The compression spring 60 fits about and is held in position by pin 62. The spring 60 exerts a force between the end wall of top plate 48 and the pin 58 tending to force the support 50 into one or the other of its detent positions, i.e., a position where the pins 54, 54' are against the stops form by notches 56, 56'. The lower side of the support 50, i.e., the side not visible in FIG. 3, is generally formed with a shaped aperture, e.g., square, for receiving an end of the handle 36 to enable the support 50 to be rotated so as to move the lever arm 34 and thereby lock and unlock the doors 12.

It has been found that after some period of use, the compression spring 60 no longer suffices to maintain the support 50 in its full detent positions. It will be appreciated that the latching mechanism 24 is preferably located at a relatively low height on the truck body so as to be easily accessible by an operator. Consequently, the second arm is of significant length and weight. This weight combined with the tendency of the rod 16 to turn into the locked position causes a load to be placed on the compression spring 60 tending to force the arm 34 out of the detent positions. Since the spring 60 loses its compressive strength, the lever arm 34 may sag allowing the rod 16 to rotate so that the flanges 18 are not in a position to fully engage the edges of the doors 12. Not only does this allow the doors 12 to opened without releasing the latch mechanism 24, it also allows the flanges 18 to contact the door surface when the mechanism 24 is placed in the open or unlocked position. The flanges 18 scratch the door surfaces defacing them and allowing corrosion to set in. It is therefore desirable to provide means to assure positive positioning of the latching mechanism.

Figure 4:
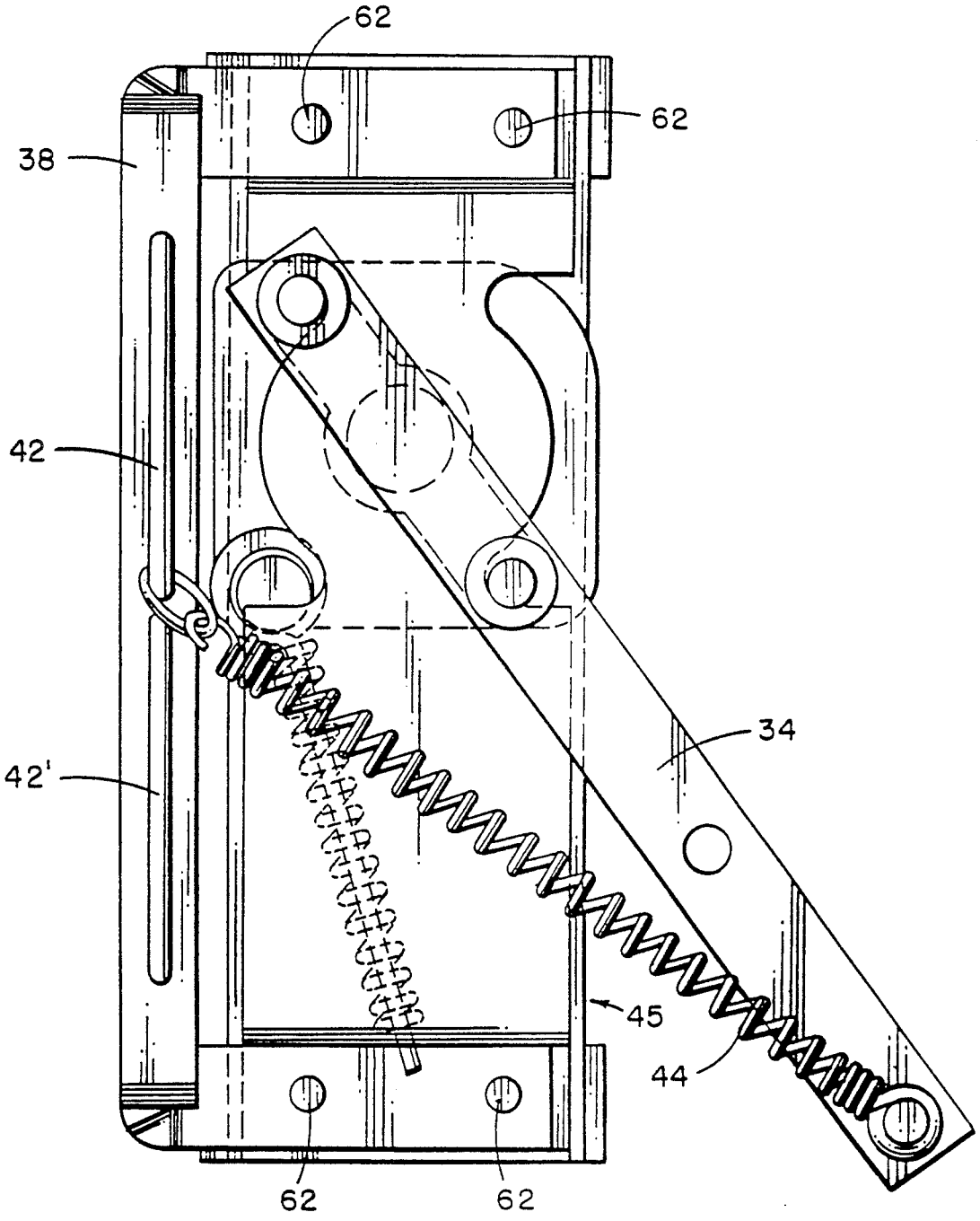
FIG. 4 is a planar view of the mechanism of FIG. 3 with the present invention incorporated.

The secondary support 38 and tension spring 44 of FIG. 2 provide the means to assure positive positioning of the latching mechanism 24. FIG. 4 is an enlarged view of the mechanism 24 with the support 38 and spring 44 installed. The ability of the spring 44 to slide within slot 42 provides an overcenter function such that the spring 44 pulls the arm 34 against a stop irrespective of whether arm 34 is in an up or down position. The sliding action of the spring also minimizes the extent of stretching of the spring 44 so that it is less likely to lose its tensile strength or spring constant. The lower slot 42' is used of the support is placed on an opposite side of the truck where the support 38 becomes inserted.

Figure 5A:
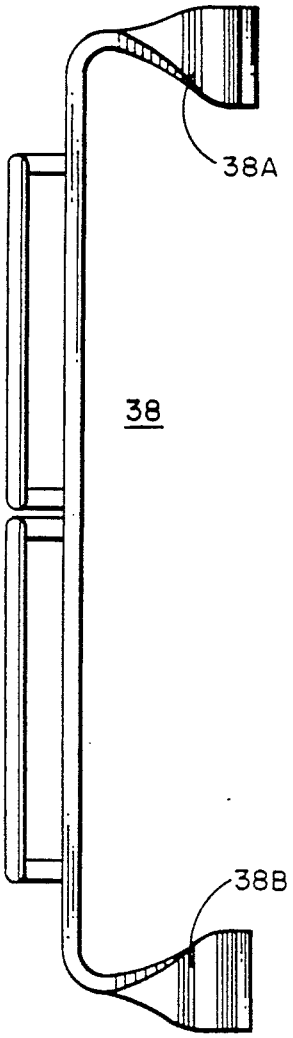
FIGS. 5A and 5B are side and end views respectively of a support for attaching a secondary spring to the apparatus of FIG. 3.
Figure 5B:
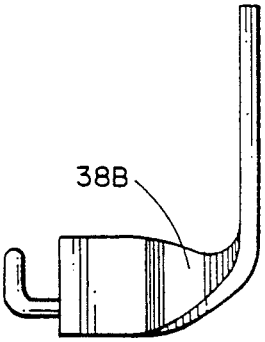

FIGS. 5A and 5B are side and end views respectively of the secondary support 38. From these figures, it can be seen that the support 38 is raised above the top plate 48 by the end members 38A and 38B so that the spring 44 is in a plane above the lever arm 34.

Another advantage of the present invention is that the support 38 and spring 44 may be added to latching mechanisms in use. The support 38 attaches to the existing mechanism 24 using mounting bolts passing through the apertures 62 in the ends of the mechanism 24. In comparison, the top plate 48 is welded to the base plate 46 in the mechanism 24 so that the spring 60 is not easily replaceable.

While the invention has been described in what is considered to be a preferred embodiment, various modifications and arrangements will become apparent to those skilled in the art. It is intended therefore that the invention not be limited to the disclosed embodiment but be interpreted within the full spirit and scope of the appended claims.

What is claimed is:

1. A latching mechanism for roll-up type doors on a vehicle truck body, the doors being held in a closed position by flanges extending from a rotatable rod, the rod extending through the truck body adjacent a top edge of the doors, a first lever arm coupled to one end of the rod for enabling rotation of the rod, and a second lever arm coupled between the first lever arm and the latching mechanism for controlling the relative rotational position of the rod in response to actuation of the latching mechanism, the latching mechanism comprising a housing assembly for attachment to the truck body, a rotatable support mounted in said housing, a third lever arm attached to said support and extending from said latching mechanism, an end of said third lever arm being connected to said second lever arm for effecting movement thereof in response to rotation of said support, first and second stops for limiting rotation of said support, a tension spring having one end connected adjacent said end of said third lever arm, and means for connecting a second end of said spring in sliding engagement with said housing assembly, said spring being operative to maintain said support against a selected one of said stops by sliding on said connecting means such that said spring tensions said third lever arm toward said selected one of said stops.

2. The latching mechanism of claim 1 wherein said connecting means comprises a secondary support extending generally in a direction of motion of said second lever arm and attached to said housing, at least one slot formed in said secondary support for receiving said one end of said tension spring, said slot being arranged to permit sliding motion of said one end of said spring in said general direction of motion of said second lever arm.

3. A latching mechanism for assuring positive positioning of a lever arm comprising a housing, means for mounting a lever arm for limited rotational movement about an axis within said housing, a compression spring coupled between said mounting means and said housing for urging said lever arm into a selected position, a support attached to said housing and including a slot oriented generally in a direction of motion of said lever arm over said limited motion thereof, a tension spring having one end thereof attached to a distal end of said lever arm and a second end thereof coupled to said slot, said second spring end sliding lengthwise of said slot when said lever arm is rotated so that said tension spring always operates overcenter of said lever arm.

4. In a latching mechanism for positioning a lever arm against respective first and second displaced end stops, said lever arm having one end coupled for rotation about an axis within said latching mechanism and a second distal end displaced from said mechanism, compression spring means coupled to said mechanism and said one end of said lever arm for urging said lever arm against said end stops, the improvement comprising a support attached to said mechanism and a tension spring coupled between said support and said second end of said lever arm for additionally urging said arm against said end stops.

* * * * *